US005745919A

United States Patent [19]

Kraatz

[11] Patent Number: 5,745,919

[45] Date of Patent: May 5, 1998

[54] CUT-RESISTANT PROTECTIVE GLOVE WITH LEATHER SHEATH

[75] Inventor: Gerald A. Kraatz, Strongsville, Ohio

[73] Assignee: Whizard Protective Wear Corp., Birmingham, Ohio

[21] Appl. No.: 738,625

[22] Filed: Oct. 29, 1996

[51] Int. Cl.[6] ..... A41D 19/00

[52] U.S. Cl. ..... 2/161.6; 2/161.8; 2/159; 2/163

[58] Field of Search ..... 2/158, 159, 160, 2/161.1, 161.2, 161.3, 161.4, 161.5, 161.6, 161.7, 161.8, 162, 163, 164, 166, 167, 168, 169, 170

[56] References Cited

U.S. PATENT DOCUMENTS

| | | | |
|---|---|---|---|
| 373,048 | 11/1887 | Burr | 2/158 |
| 801,753 | 10/1905 | Ulrich . | |
| 983,649 | 2/1911 | Scully . | |
| 1,483,595 | 2/1924 | Read | 2/159 X |
| 2,025,710 | 12/1935 | Beemer | 2/159 |
| 2,114,022 | 1/1938 | Jensen . | |
| 2,298,959 | 12/1942 | McClurken . | |
| 2,705,327 | 4/1955 | Gitt | 2/161.8 |
| 3,548,413 | 12/1970 | Jackson . | |
| 3,633,216 | 1/1972 | Schonboltz . | |
| 3,883,898 | 5/1975 | Byrnes | 2/167 |
| 3,916,448 | 11/1975 | Hamel . | |
| 3,953,893 | 5/1976 | Byrnes, Sr. . | |
| 4,004,295 | 1/1977 | Byrnes, Sr. . | |
| 4,172,293 | 10/1979 | Vistins . | |
| 4,384,449 | 5/1983 | Byrnes et al. | 2/167 X |
| 4,433,439 | 2/1984 | Sidman et al. . | |
| 4,454,611 | 6/1984 | Tschirch et al. . | |
| 4,470,251 | 9/1984 | Bettcher | 2/161.6 X |
| 4,514,460 | 4/1985 | Johnson . | |
| 4,526,828 | 7/1985 | Fogt et al. . | |
| 4,573,220 | 3/1986 | Baker | 2/161.1 |
| 4,589,940 | 5/1986 | Johnson . | |
| 4,651,514 | 3/1987 | Collett | 2/167 X |
| 4,742,578 | 5/1988 | Seid . | |
| 4,751,747 | 6/1988 | Banks et al. | 2/161.8 X |
| 4,777,789 | 10/1988 | Kolmes et al. | 2/167 X |
| 4,779,290 | 10/1988 | Welch et al. . | |
| 4,785,479 | 11/1988 | Watanabe . | |
| 4,825,470 | 5/1989 | Horio | 2/161.8 |
| 4,833,733 | 5/1989 | Welch et al. . | |
| 4,838,017 | 6/1989 | Kolmes et al. | 2/167 X |
| 4,847,918 | 7/1989 | Sturm . | |
| 4,864,661 | 9/1989 | Gimbel . | |
| 4,912,781 | 4/1990 | Robins et al. . | |
| 4,936,085 | 6/1990 | Kolmes et al. . | |
| 5,028,050 | 7/1991 | Freyer . | |
| 5,088,123 | 2/1992 | MacDonald . | |
| 5,113,532 | 5/1992 | Sutton . | |
| 5,119,512 | 6/1992 | Dunbar et al. . | |
| 5,177,948 | 1/1993 | Kolmes et al. . | |
| 5,187,815 | 2/1993 | Stern et al. . | |
| 5,224,363 | 7/1993 | Sutton . | |
| 5,231,700 | 8/1993 | Cutshell . | |
| 5,248,548 | 9/1993 | Toon . | |
| 5,287,690 | 2/1994 | Toon . | |
| 5,336,555 | 8/1994 | Darras et al. . | |
| 5,423,168 | 6/1995 | Kolmes et al.. . | |
| 5,442,815 | 8/1995 | Cordova et al. . | |
| 5,442,816 | 8/1995 | Seketa . | |

*Primary Examiner*—C. D. Crowder.
*Assistant Examiner*—Shirra L. Jenkins
*Attorney, Agent, or Firm*—Watts, Hoffmann, Fisher & Heinke Co.,LPA

[57] ABSTRACT

A protective glove comprising a cut-resistant glove and a grip enhancing sheath affixed to the cut-resistant glove. The sheath is preferably made of leather and is symmetrical providing a gripping surface that overlies substantially similar portions of a front and back side of the cut-resistant glove such that the protective glove is adapted for both right and left handed use. In one embodiment of the protective glove, the sheath is configured to overlie the thumb, index and middle finger stalls of the cut-resistant glove as well as a portion of the palm area of the glove. In a second embodiment of the protective glove, the sheath is configured to overlie the thumb and index finger stalls of the cut-resistant glove as well as a portion of the palm area of the glove.

18 Claims, 4 Drawing Sheets

CUT-RESISTANT PROTECTIVE GLOVE WITH LEATHER SHEATH

FIELD OF THE INVENTION

The present invention relates to a cut-resistant protective glove and, more particularly, to a cut-resistant protective glove having a symmetrical leather grasping portion or sheath affixed to a cut-resistant glove for increased gripping ability and which is suitable for right or left handed use.

BACKGROUND OF THE INVENTION

Cut-resistant protective gloves are widely used in industry to protect a user's hand from accidentally being cut. Typical cut-resistant protection gloves are knit from cut-resistant yarn having a core and one or more outer wrappings, and incorporating cut-resistant materials such as high strength synthetic fibers and/or steel wire.

A problem associated with cut-resistant protective gloves made from such yarn arises from the relatively low coefficient of friction of the yarn, resulting in gloves that do not grip oily or greasy surfaces well, especially flat surfaces such as sheet metal.

What is needed is a cut-resistant glove that additionally has a gripping surface comprised of a material that is less slippery than current cut-resistant protective glove materials and that is limited in area to portions that, in use, apply the most significant gripping pressure. Thus, large portions of the glove retain the high flexibility of a typical cut-resistant knit glove. What is also needed is a cut-resistant protective glove adapted to be used on either a user's right or left hand, which in addition to other advantages, increases the useful life of the glove.

SUMMARY OF THE INVENTION

The protective glove embodying this invention comprises a cut-resistant glove and a grip-enhancing sheath affixed to and overlying a portion of the cut-resistant glove. The sheath is essentially symmetrical with respect to the front and back sides of the cut-resistant glove thereby permitting the glove to be worn on either a user's right or left hand, which among other advantages, provides for an increased useful life of the glove.

The sheath preferably is fabricated of a soft, flexible split leather, a material that enhances gripping ability, especially with respect to picking up and manipulating oily or greasy objects. Gripping ability is enhanced because the leather readily absorbs oil and grease and thereby avoids surface film slipperiness. The preferred cut-resistant glove is fabricated by knitting a cut-resistant yarn to form a normal wrist length glove having a thumb stall and four finger stalls to accept the thumb and four fingers of a user.

In one embodiment of the protective glove, the leather sheath is comprised of two identically shaped soft, flexible leather pieces that are sewn together, turned inside out and then affixed to the cut-resistant glove. The sheath includes a thumb stall, open to receive the thumb stall of the cut-resistant glove, an index finger stall, open to receive the cut-resistant glove index finger stall, and symmetrical portions that extend from the stalls over a portion of a palm area of the front and over a similar area of the back side of the cut-resistant glove. An alternative embodiment of the protective glove includes a sheath with a middle finger stall.

The sheath is affixed to the cut-resistant glove by sewing it to the cut-resistant glove along the open peripheral edges through which the cut-resistant glove is received.

It has been found that most of the gripping force is applied with the thumb and the index and middle fingers. The leather sheath provides for an improved grip enhancing gripping surface where it is most needed, that is, the thumb and the first finger or the first two fingers. In addition, since the sheath is fabricated of soft, flexible leather the dexterity and flexibility of the thumb and first two fingers is excellent. The symmetrical configuration of the sheath provides the improved gripping surface whether the protective glove is worn on the right or left hand. Further, since the sheath does not overlie the ring and little fingers, the protective glove is light-weight and provides for flexibility and dexterity of the fingers that do not apply as much gripping force.

In its broader aspects a protective glove is disclosed comprising a cut-resistant glove comprised of a cut-resistant fabric and having a first side and a second side, the first and second sides being similarly configured such that the glove is suitable to be worn on either of a right hand or left hand of a user. The protective glove further includes a grip-enhancing sheath affixed to the cut-resistant glove and having substantially similar portions overlaying the first side and the second side, the similar portions being smaller than the first and second sides.

These and other advantages and features of this invention will be clearly understood from the following detailed description of the invention in conjunction with the accompanying drawings.

DETAILED DESCRIPTION

Figure 1:
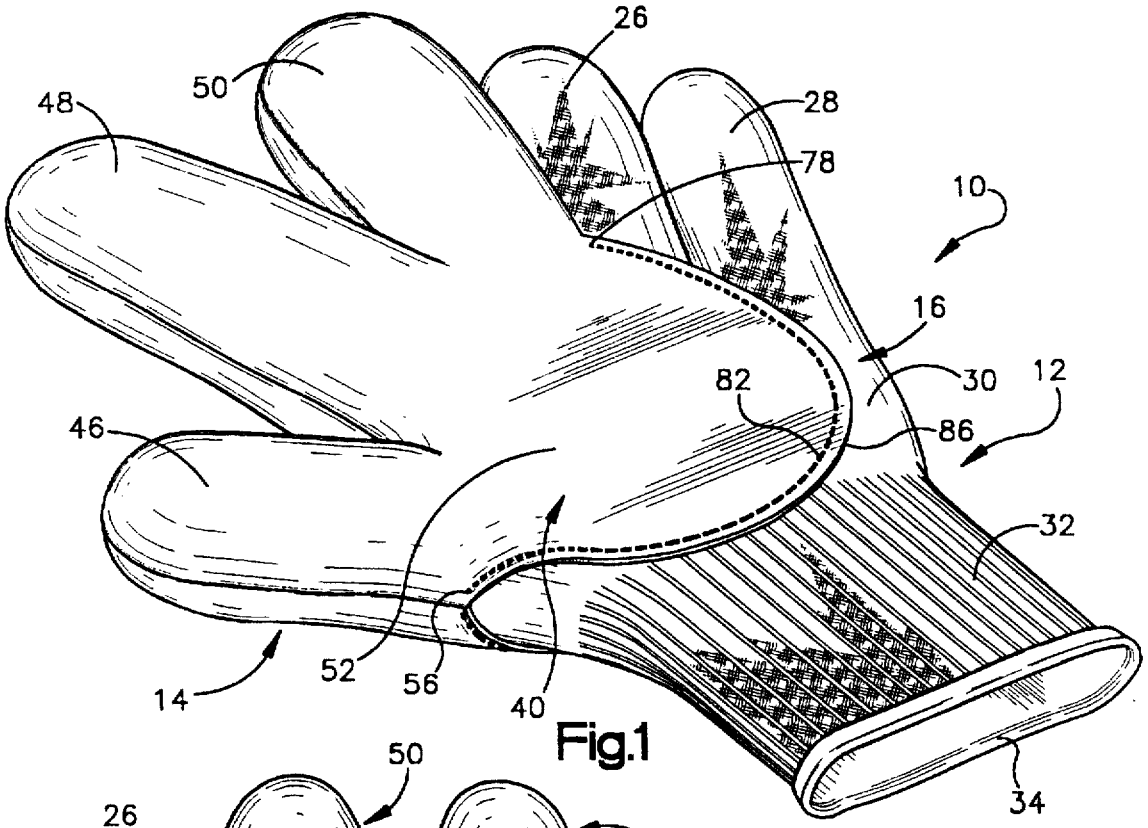
FIG. 1 is a perspective view of the protective glove of the present invention comprising a cut-resistant glove and a sheath affixed to the cut-resistant glove.
Figure 3:
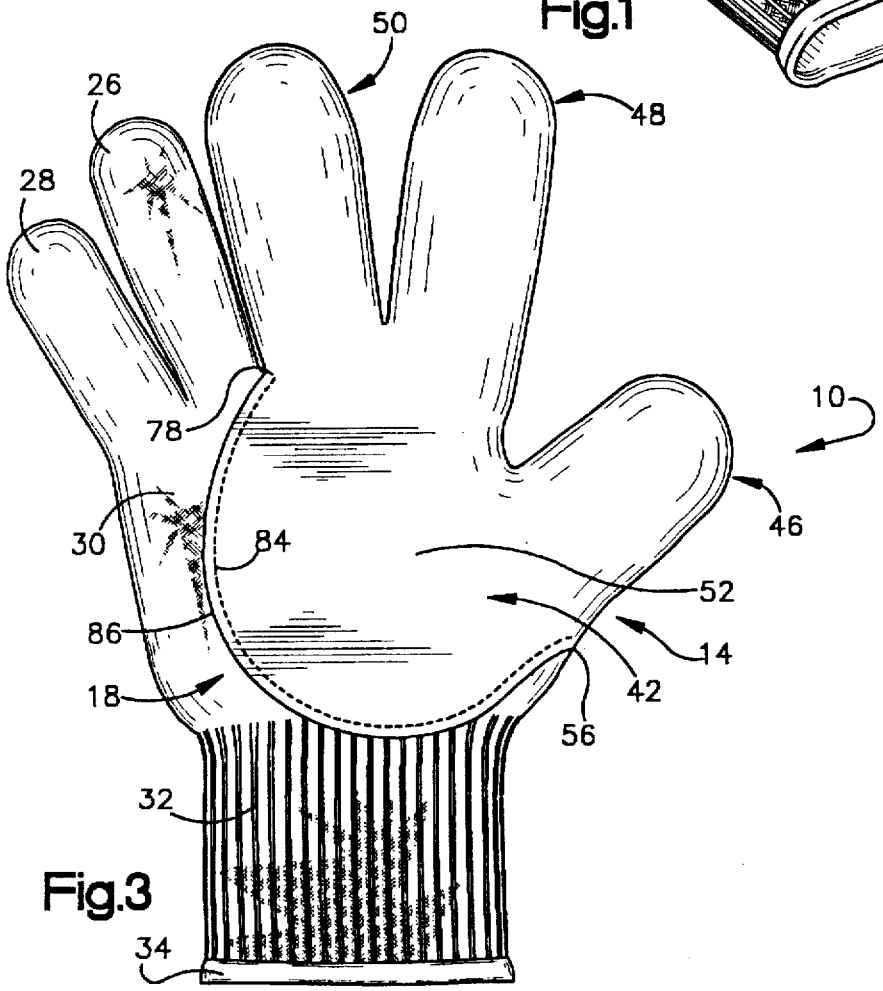
FIG. 3 is a back elevation view of the protective glove of FIG. 1.
Figure 2:
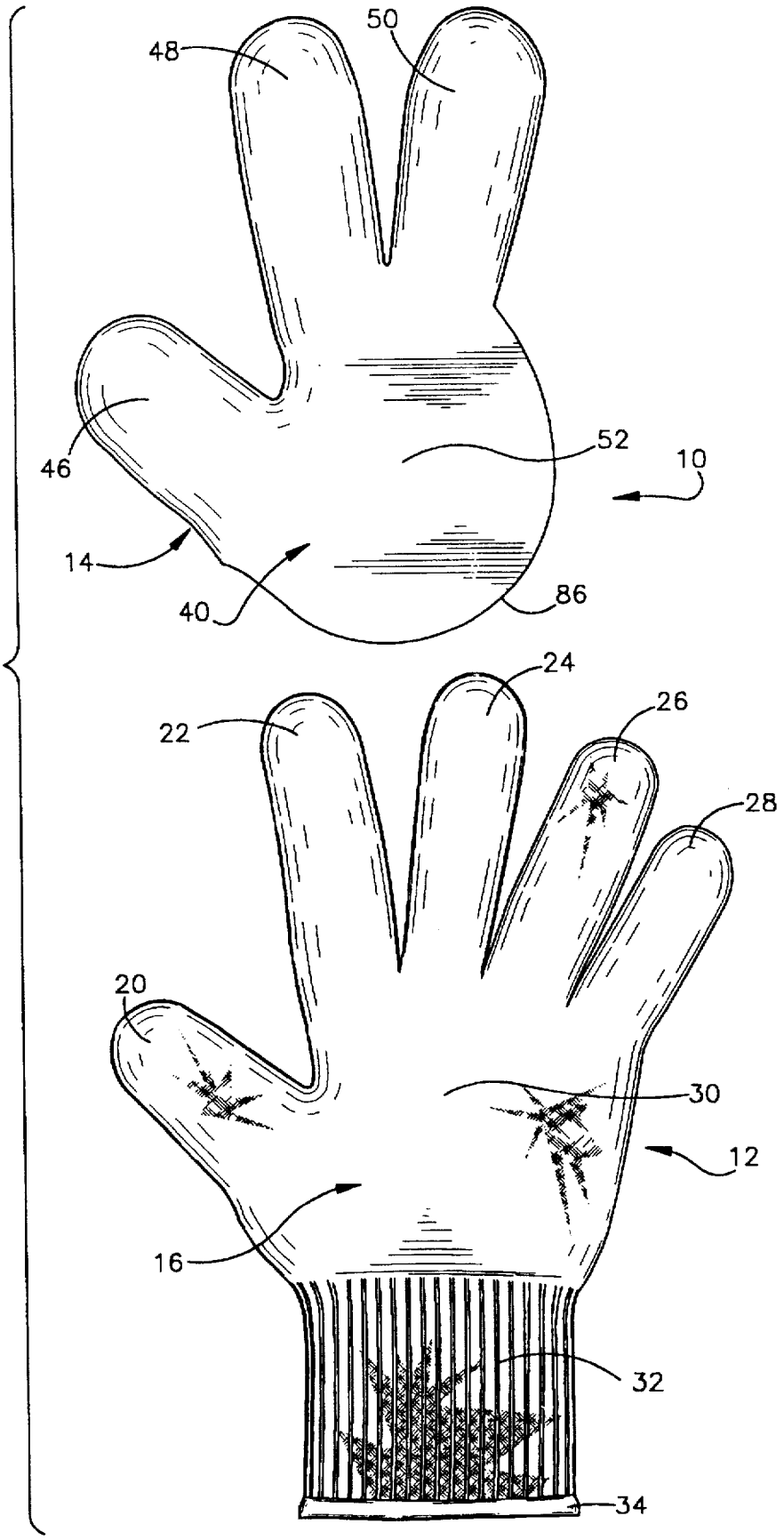
FIG. 2 is an exploded front elevation view of the protective glove of FIG. 1 with the cut-resistant glove separated from the sheath.

A protective glove of the present invention is shown generally at 10 in FIGS. 1–3. The protective glove 10 comprises a cut-resistant glove 12 and a gripping portion or sheath 14 which provides an enhanced gripping surface. Preferably, the sheath 14 is comprised of a soft, flexible leather, for example, split leather hide tanned from a belly portion of a cow skin. The split leather sheath 14 enhances gripping ability because it readily absorbs oil and grease and thereby avoids slipperiness resulting from a film of oil or grease between the gripping surface and an object to be gripped. Preferably, the leather has a weight of 2¾ ounces per square foot. The cut-resistant glove 12 is preferably knitted of a cut-resistant yarn 15 and includes two opposite sides 16, 18, which are symmetrical, permitting the glove to be used on a right or left hand of a user. The cut-resistant knitted glove 12 includes a thumb stall 20, an index finger stall 22, a middle finger stall 24, a ring finger stall 26 and a little finger stall 28. The stalls 20–28 extend from a central area 30 that forms part of both opposite sides 16, 18 of the cut-resistant glove 12. The central area 30 includes a palm area and a back area that corresponds to the palm area of the cut-resistant glove 12. A cuff area 32, which overlies and protects the user's wrist, has elastic threads (not shown) sewn through the knitted yarn 15 to provide a close fit over the wrist area. A peripheral edge 34 of the cuff is hemmed to prevent unraveling of the glove yarn 15 or the elastic threads through the cuff.

Figure 4:
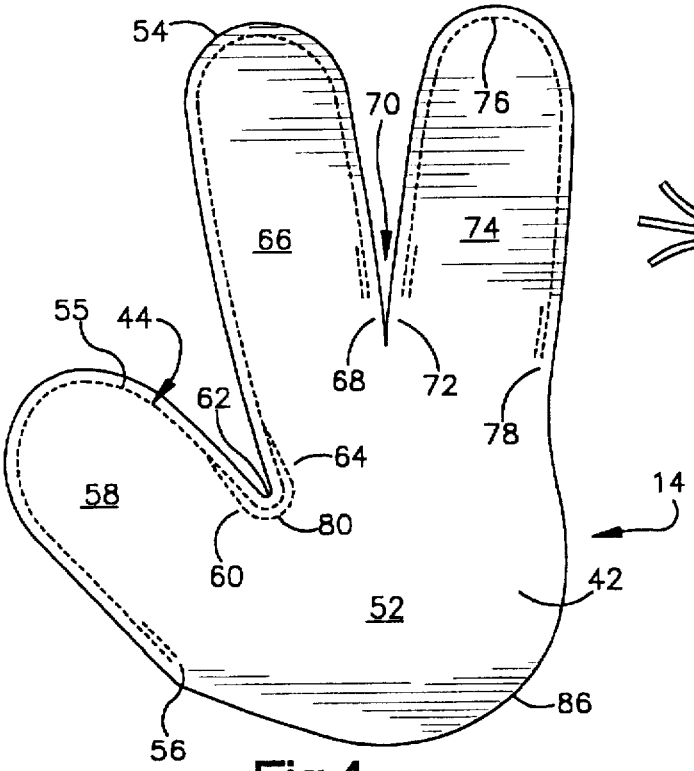
FIG. 4 is a front elevation view of the leather sheath of FIG. 1 prior to being turned inside out and affixed to the cut-resistant glove.

The sheath 14 is comprised of substantially identically shaped first and second pieces 40, 42 of leather. The pieces 40, 42 are placed one upon the other and sewn together using suitable thread 44 along a portion of the periphery of pieces in a pattern shown in FIG. 4. After the pieces 40, 42 are sewn, the sheath 14 is turned inside out before being sewn to the cut-resistant glove 12.

The sheath 14 includes a thumb stall 46 having an opening for receiving the thumb stall 20 of the cut-resistant glove 12, an index finger stall 48 having an opening for receiving the cut-resistant glove index finger stall 22, and a middle finger stall 50 having an opening for receiving the cut-resistant glove middle finger stall 24. Symmetrical palm and back portions 52 of the sheath 14 extend from the thumb, index finger, and middle finger stalls 46, 48, 50 and overlie a portion of the central area 30 including respective portions of the palm area and the back area of the two sides 16, 18 of the cut-resistant glove.

When the leather pieces 40, 42 are stitched together, the thread 44 is sewn approximately ⅛ inch in from a peripheral edge 54 of the pieces 40, 42. For each piece, a split leather side of the leather is positioned facing inwardly before sewing the pieces together. In this way, the split leather side of each piece 40, 42 will be exposed after sewing. One length of stitching 55 extends from an outer base 56 of a thumb region 58 around a peripheral edge of the thumb region past a location at an inner base 60 of the thumb region 58 and continues around a crotch region 62 between the thumb region inner base 60 and a thumb-facing base 64 of an index finger region 66 and further continues along a peripheral edge of the index finger region 66 and terminates at a middle-finger-facing base 68 of the middle finger region 66. There is no stitching in a crotch region 70 between the thumb-facing base 68 and a index finger facing base 72 of a middle finger region 74 to provide increased glove flexibility.

Another length of stitching 76 between the pieces 40, 42 extends from the base 72 around a peripheral edge of the middle finger region 74 and terminates at an outer base 78 of the middle finger region 74. For increased strength at the attachment of the two pieces 40, 42 in the thumb-index finger crotch region 62, another length of stitching 80 runs adjacent to the stitching section 55 in the crotch region 62. After the pieces 40, 42 are stitched, the sheath 14 is turned inside out and affixed to the cut-resistant glove 12 by sewing using the thread 44.

After the pieces 40, 42 are sewn together, a blunt rod is used to push the stalls of the cut-resistant glove into the respective stalls of the sheath 14. Next, the palm and back portions 52 of both pieces 40, 42 of the sheath 14 are properly aligned over respective palm and back areas of the central area 30 of the cut-resistant glove opposite sides 16, 18 so that the sheath lies flat on the cut-resistant glove and there are no wrinkles in the sheath or the cut-resistant glove.

Then each side of the sheath 14 is sewn to a respective side of the cut-resistant glove. A first length of stitching 82 affixes the piece 40 to the front side 16 of the cut-resistant glove 12 while a second length of stitching 84 affixes the second piece of leather or pad 42 to the back side 18 of the cut-resistant glove. Both the first and second lengths of stitching 82, 84 extend between the outer base 56 of the thumb region 58 around respective palm and back portions 52 of the sheath 14 to the outer base 78 of the middle finger region 74. The first and second lengths of stitching 82, 84 are spaced inwardly from a peripheral edge 86 of the palm and back portions 52 by approximately ⅛ inch.

Figure 5:
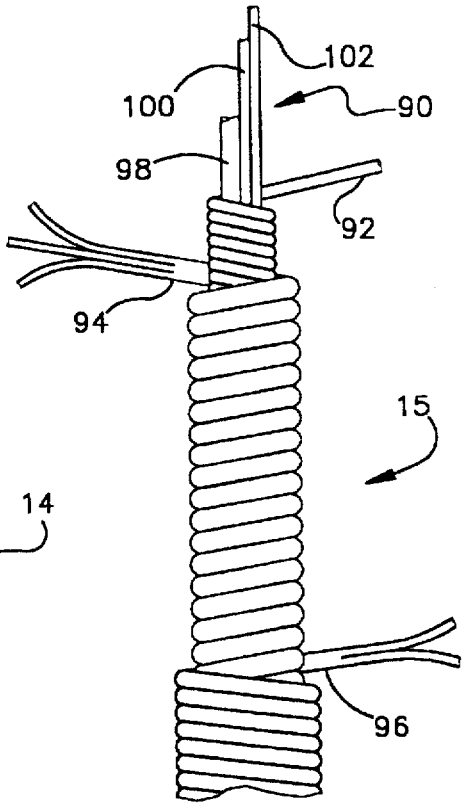
FIG. 5 is an enlarged view of a cut-resistant yarn used to knit the cut-resistant glove.
Figure 6:
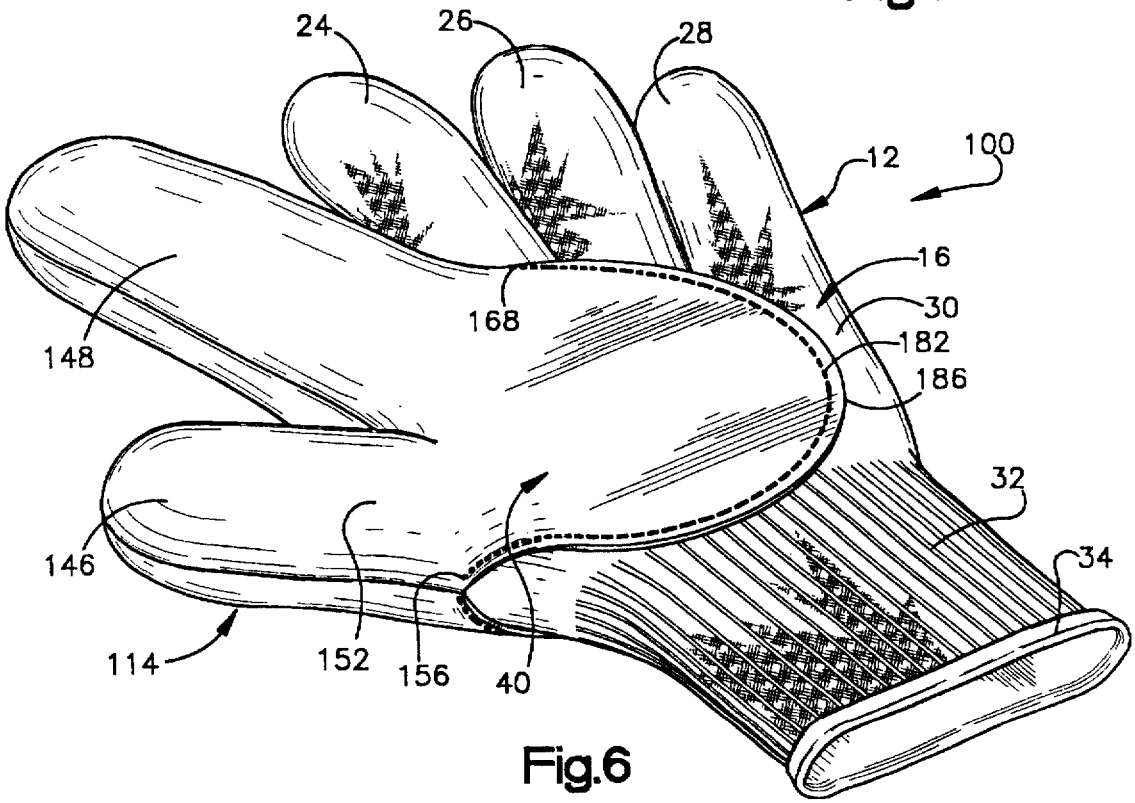
FIG. 6 is a perspective view of a second embodiment of a protective glove of the present invention comprising a cut-resistant glove and a sheath affixed to the cut-resistant glove.
Figure 7:
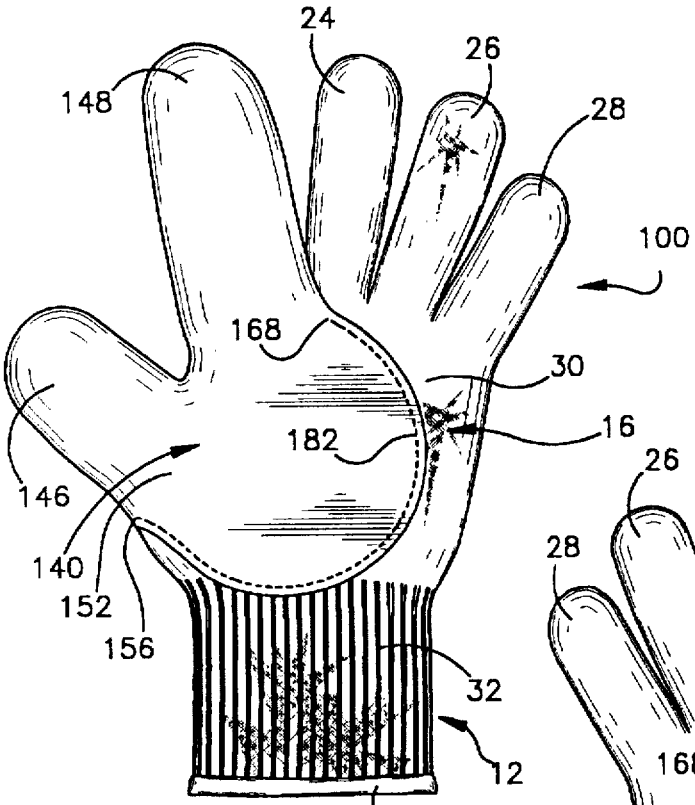
FIG. 7 is a front elevation view of the protective glove of FIG. 6.
Figure 8:
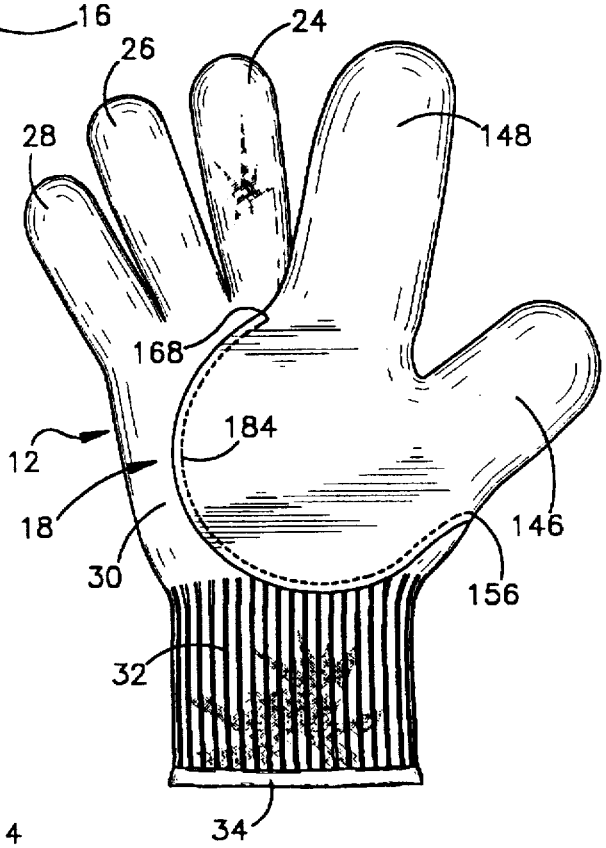
FIG. 8 is a back elevation view of the protective glove of FIG. 6.

As shown in FIG. 5, the yarn preferred 15 employed in knitting the cut-resistant glove 12 comprises a core 90 having first, second and third wrappings 92, 94, 96 of synthetic fiber each wound in an opposite direction from the next to balance the forces incident to the wrappings and to assist in holding the wrappings in place on the core 90. The core 90 is comprised of one strand 98 of cut-resistant fiber, specifically 400 denier high strength liquid crystal polymer fiber, and two strands 100, 102 of wire 0.002 inch in diameter. A suitable fiber is manufactured by the Hoechst Celanese Corporation and marketed under the trademark VECIRAN HS. A suitable wire material is fully annealed stainless steel, such as 304 stainless steel.

The first wrapping 92 is one strand or cut-resistant fiber, specifically 360 denier high strength polyethylene fiber, often referred to as extended chain or stretched polyethylene. A suitable fiber is marketed by Hoechst Celenese Corporation under the trademark CERTRAN. The first wrapping 92 is wound about the core 90 at a rate of 10 turns per inch and the turns are essentially directly adjacent one to the next to substantially fully cover the core.

The second wrapping 94 is comprised of three strands of 70 denier micropolyester fiber, which is a polyester in which the individual fibers forming the strands are less than one denier each. The three strands are combined as a single strand for wrapping to provide a total wrapping of 210 denier and are wrapped at a rate of 8 turns per inch. The turns are essentially directly adjacent one to the next to substantially fully cover the underlying first wrapping 92.

The third wrapping 96 is comprised of two stands of 300 denier polyester fiber. The two strands are combined as a single stand for wrapping to provide a total wrapping of 600 denier and wrapped at a rate of 8 turns per inch. The turns are essentially directly adjacent one to the next to substantially fully cover the underlying second wrapping 94. In the preferred embodiment, the strands are solution dyed to a desirable color.

The core components 98, 100, 102 and the first wrapping 92 are highly cut-resistant. The second and third wrappings 94, 96 provide bulk and a comfortable feel to the yarn and hence to the cut-resistant glove 12. The resultant yarn 15 is cut-resistant, flexible, and readily machine-knittable on conventional knitting machines. The cut-resistant glove 12 is knitted one end in on a ten cut Shima knitting machine. Of course, other cut-resistant yarns can be used to make a suitable cut-resistant glove for combining with a leather sheath or covering in accordance with the present invention. For example, suitable cut-resistant yarns can utilize a core or wrappings comprised of fiberglass. Also they can utilize a core or wrapping of cut-resistant synthetic fibers of, for example, such materials as aramid (e.g., KEVLAR®), SPECTRA® brand high strength polyethylene, or fibers of liquid-crystalline polybenzoxazole or polybenzothiazole polymer, all of which have a tenacity of greater than 10 grams per denier and are considered high strength synthetic fibers; and/or normal strength liquid crystal polymer (e.g., VECTRAN M), which is highly cut-resistant. In addition, wire can be used as a wrapping.

A second embodiment of a protective glove of the present invention is shown at 100 in FIGS. 6–9. The protective glove 100 comprises a cut-resistant glove 12 and a gripping portion or sheath 114 which provides an enhanced gripping surface. The cut-resistant glove 12 is identical in configuration and composition to the cut-resistant glove 12 described in the first embodiment and, as such, identical reference numbers for the gloves 12 and for features of the gloves will be used in both the second embodiment and in the first embodiment. The protective glove 100 is somewhat more flexible than the protective glove 10 disclosed in the first embodiment because the sheath 114 does not overlie a middle finger stall 24 of the cut-resistant glove 12.

As in the first embodiment, the sheath 114 is comprised of a soft, flexible split leather tanned from a belly portion of a cow skin. The cut-resistant glove 12 is preferably knitted of the cut-resistant yarn 15 described above and includes two opposite sides 16, 18 which are symmetrical thereby permitting the glove to be used on a right or left hand of a user. The cut-resistant knitted glove 12 includes a thumb stall 20, an index finger stall 22, the middle finger stall 24, a ring finger stall 26 and a little finger stall 28. The stalls 20–28 extend from a central area 30 that forms part of both sides 16, 18. The central area so includes a palm area and a back area corresponding to the palm area of the cut-resistant glove 12. A cuff area 32, that overlies and protects the user's wrist, has elastic threads (not shown) sewn through the knitted yarn 15 comprising the cut-resistant glove 12 so as to provide a close fit over the wrist area. A peripheral edge 34 of the cuff is hemmed to prevent unraveling of the glove yarn 15 or the elastic threads through the cuff.

Figure 9:
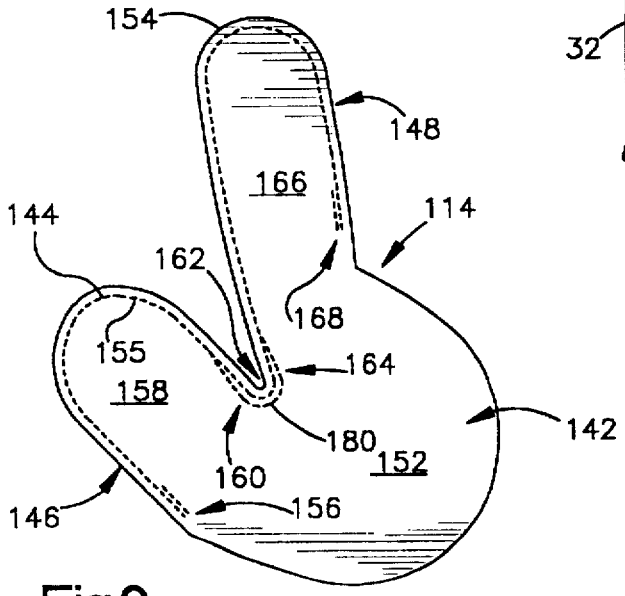
FIG. 9 is a front elevation view of the leather sheath of FIG. 6 prior to being turned inside out and affixed to the cut-resistant glove.

The sheath 114 is comprised of substantially identically shaped first and second pieces 140, 142 of leather. The pieces 140, 142 are placed one upon the other and sewn together using suitable thread 144 along a portion of the peripheral of the respective pieces in a pattern as seen in FIG. 9. After the pieces 140, 142 are stitched, the sheath 114 is reversed before being sewn to the cut-resistant glove 12, that is, the sheath 114 is turned inside out before being sewn to the cut-resistant glove 12.

The sheath 114 includes a thumb stall 146 having an opening for receiving the thumb stall 20 of the cut-resistant glove 12 and an index finger stall 148 having an opening for receiving the cut-resistant glove index finger stall 22. Palm and back portions 152 of the sheath 114 extend from the thumb and index finger stalls 146, 148 and overlie a portion of the central area 30 including reside, respective portions of the palm area and the back area of the two sides 16, 18 of the cut-resistant glove.

When the leather pieces 140, 142 are stitched together, the thread 144 is sewn approximately ⅛ inch in from a peripheral edge 154 of the pieces. One length of stitching 155 between the pieces 140, 142 extends from an outer base 156 of a thumb region 158 around a peripheral edge of the thumb region past a location at an inner base 160 of the thumb region 158 and continues around a crotch region 162 between the thumb region inner base 160 and a thumb facing base 164 of an index finger region 166 and further continues around a peripheral edge of the index finger region 166 and terminates at a middle finger facing base 168 of the middle finger region 166.

For increased strength of the attachment of the two pieces 140, 142 in the thumb-index finger crotch region 162, another length of stitching 180 between the pieces 140, 142 runs adjacent to the stitching section 155 in the crotch region 162. After the pieces 140, 142 are stitched, the sheath 114 is reversed and affixed to the cut-resistant glove 12 by sewing using the thread 144. A first length of stitching 182 affixes the first piece of leather or pad 140 to one side 16 of the cut-resistant glove 12 while a second length of stitching 184 affixes the second piece of leather or pad 142 to the opposite side 18 of the cut-resistant glove. Both the first and second lengths of stitching 182, 184 extend between the outer base 156 of the thumb region 158 around the respective palm and back portions 152 of the sheath 114 to the outer base 168 of the index finger region 166. The first and second lengths of stitching 182, 184 are spaced inwardly from a peripheral edge 186 of the palm portion 152 by approximately ⅛ inch.

While the present invention has been described with a degree of particularity, it is the intent that the invention include all modifications and alterations of the disclosed embodiments falling within the spirit and scope of the appended claims.

I claim:

1. A protective glove comprising:

a) a cut-resistant glove comprised of a cut-resistant fabric and having a first side and a second side, the first and second sides being similarly configured such that the glove is suitable to be worn on either of a right hand or left hand of a user; and b) a grip-enhancing sheath affixed to the cut-resistant glove and having substantially symmetrical portions overlaying the first side and the second side, the symmetrical portions being smaller than the first and second sides.

2. The protective glove of claim 1 wherein the sheath is comprised of leather.

3. The protective glove of claim 1 wherein the cut-resistant glove includes a thumb stall and an index finger stall and the sheath includes stalls limited to a thumb stall and an index finger stall which respectively receive the cut-resistant glove thumb and index finger stalls.

4. The protective glove of claim 1 wherein the cut-resistant glove includes a thumb stall, an index finger stall, and a middle finger stall and the sheath includes stalls limited to a thumb stall, an index finger stall, and a middle finger stall which respectively receive the cut-resistant glove thumb, index, and middle finger stalls.

5. The protective glove of claim 3 or 4 wherein the substantially symmetrical portions of the sheath include portions that overlie portions of a central area of the first and second sides of the cut-resistant glove.

6. The protective glove of claim 5 wherein the sheath is comprised of a first piece and a substantially identical second piece sewn together and turned inside out before being affixed to the cut-resistant glove and further wherein the sheath is affixed to the cut-resistant glove by sewing the first piece to the first side of the cut-resistant glove and sewing the second piece to the second side of the cut-resistant glove.

7. The protective glove of claim 1 wherein the cut-resistant glove is knitted of a cut-resistant yarn.

8. The protective glove of claim 7 wherein the cut-resistant yarn comprises a core and wrappings at least one of which comprises a cut-resistant synthetic fiber.

9. A protective glove suitable to be worn on either of a right hand or a left hand of a user, the protective glove comprising:

a) a cut-resistant glove comprised of a cut-resistant fabric and having a first side and a second side, the first and second sides being similarly configured; and b) a sheath including a first gripping portion affixed to the first side of the cut-resistant glove and a second gripping portion affixed to the second side of the cut-resistant glove, the first and second gripping portions being substantially symmetrical in shape to provide equal gripping functions when the protective glove is worn on either the right hand or the left hand of the user.

10. The protective glove of claim 9 wherein the sheath is comprised of leather.

11. The protective glove of claim 9 wherein the cut-resistant glove includes a thumb stall and an index finger stall and the sheath includes stalls limited to a thumb stall and an index finger stall which respectively receive the cut-resistant glove thumb and index finger stalls.

12. The protective glove of claim 9 wherein the cut-resistant glove includes a thumb stall, an index finger stall, and a middle finger stall and the sheath includes stalls limited to a thumb stall, an index finger stall, and a middle finger stall which respectively receive the cut-resistant glove thumb, index, and middle finger stalls.

13. The protective glove of claim 11 or 12 wherein the substantially symmetrical portions of the sheath include portions that overlie portions of a central area of the first and second sides of the cut-resistant glove.

14. The protective glove of claim 13 wherein the sheath is comprised of a first piece and a substantially identical second piece sewn together and turned inside out before being affixed to the cut-resistant glove and further wherein the sheath is affixed to the cut-resistant glove by sewing the first piece to the first side of the cut-resistant glove and sewing the second piece to the second side of the cut-resistant glove.

15. The protective glove of claim 9 wherein the cut-resistant glove is knitted of a cut-resistant yarn.

16. The protective glove of claim 15 wherein the cut-resistant yarn comprises a core including a strand of cut-resistant, high strength, liquid crystal polymer fiber.

17. The protective glove of claim 16 wherein the core further includes a strand of stainless steel wire.

18. The protective glove of claim 17 wherein the cut-resistant yarn includes a wrapping of cut-resistant polyethylene fiber.

* * * * *